United States Patent [19]

Rice

[11] 4,036,490

[45] July 19, 1977

[54] POLYTETRAFLUOROETHYLENE COATED EXERCISING POST KIT WITH REPETITIVE VARYING DIAMETER

[76] Inventor: Max Rice, 120 MacDougal St., New York, N.Y. 10012

[21] Appl. No.: 683,492

[22] Filed: May 5, 1976

Related U.S. Application Data

[63] Continuation-in-part of Ser. No. 569,460, April 18, 1975, Pat. No. 3,957,266.

[51] Int. Cl.[2] ..... A63B 23/00

[52] U.S. Cl. ..... 272/67; 272/68; 272/144

[58] Field of Search ..... 272/67, 68, 117, 122, 272/123, 132, 131, 116, 93, 114

[56] References Cited

U.S. PATENT DOCUMENTS

| | | | |
|---|---|---|---|
| 605,747 | 6/1898 | Sachs et al. | 272/117 |
| 1,973,593 | 9/1934 | Willner | 272/116 |
| 2,621,043 | 12/1952 | Olmstead | 272/131 |
| 2,683,603 | 7/1954 | Gackenbach | 272/68 X |
| 3,428,311 | 2/1969 | Mitchell | 272/67 |
| 3,510,130 | 5/1970 | Ferdinand | 272/67 |

*Primary Examiner*—Richard C. Pinkham
*Assistant Examiner*—William R. Browne
*Attorney, Agent, or Firm*—Richard L. Miller

[57] ABSTRACT

An exercising apparatus for purposes of attaining physical fitness; the apparatus including an inclined platform for standing upon, an upstanding polytetrafluoroethylene (also known by the trademark TEFLON) coated pole secured at its lower end to the platform and along which a person can slide his hands while firmly grasping the post, the post having bulbous enlargements intermittently along its entire length; and the pole's upper end storing removable sleeves of polytetrafluoroethylene coated, foam rubber and which are fluted, one of the sleeves being longer so as to be grasped by the hands and twisted so as to exercise the wrists, while the other sleeve is short for being grasped over the ends and twisted so as to exercise the fingers.

3 Claims, 11 Drawing Figures

38
37
10
22
16
11

42
7a
38
44
41
39
40
37
7a
42
39
40
41
43

41
42
39
40

45
46
46
38

47
47
37

POLYTETRAFLUOROETHYLENE COATED EXERCISING POST KIT WITH REPETITIVE VARYING DIAMETER

This invention relates generally to physical exercising devices, and is a continuation-in-part of co-pending application Ser. No. 569,460, filing date Apr. 18, 1975 which matured into U.S. Pat. No. 3,957,266.

A principal object of the present invention is to provide a physical exercising device that will tone up and strengthen the muscles of the body, such as those of the legs, and torso, and particularly those of the arms, hands and fingers.

Another object is to provide an exercising device which is unique from other conventional exercisers by incorporating a Teflon coated pole of intermittent bulbous enlargements along which a person slides his hands while firmly gripping the same so as to improve his grasping powers.

Another object is to provide an exercising post which additionally carries fluted removable sleeves for being twisted; one of which exercises the wrists, and the other exercises the fingers.

Other objects are to provide a polytetrafluoroethylene exercising post kit with repetitive varying diameters which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figures 6, 7, 7A, 8, 9, 10:
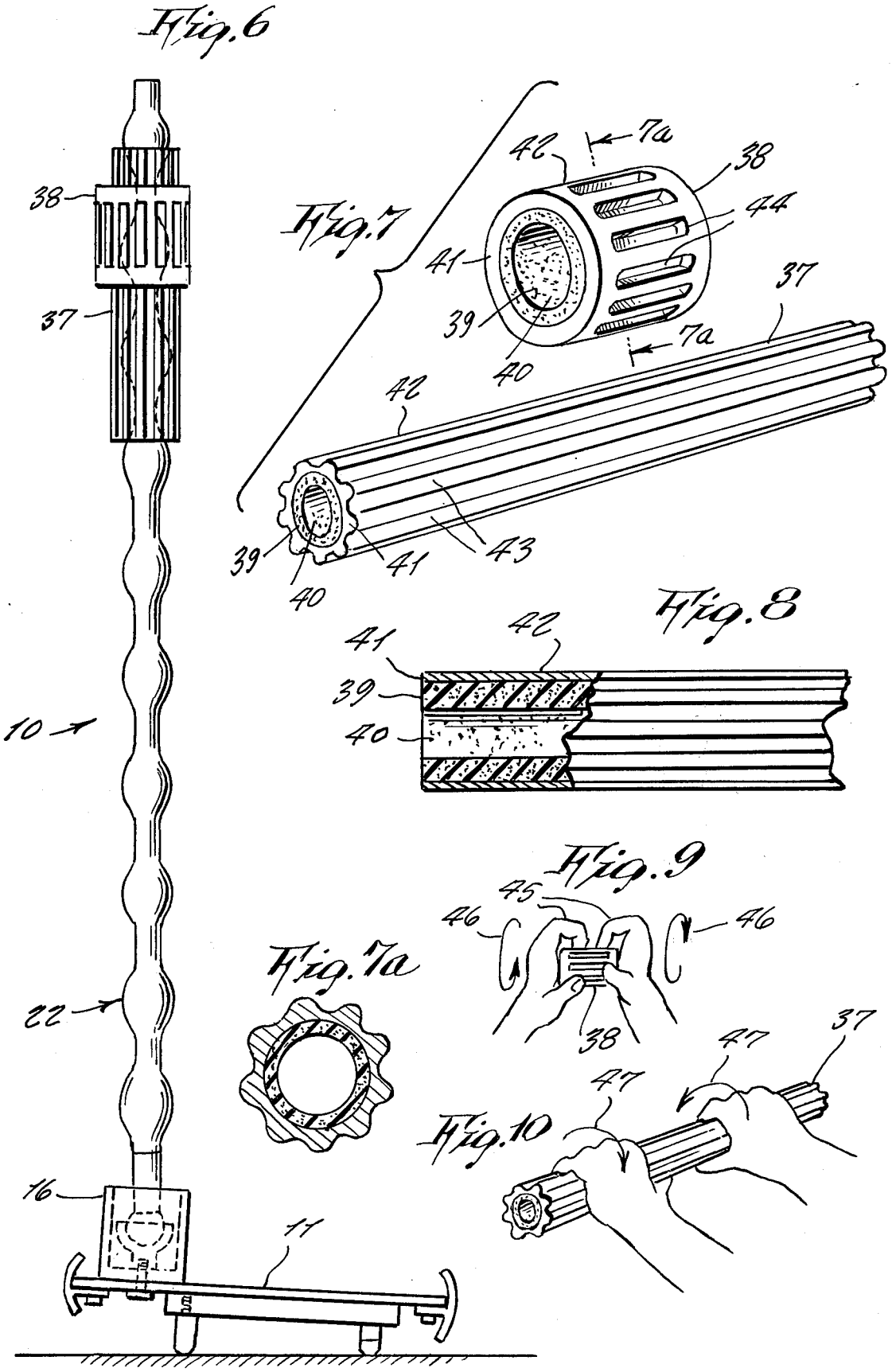
FIG. 6 is a side view of the invention, and shown with a pair of exercising sleeves stored upon an upper end thereof.
FIG. 7 is a perspective view of the exercising sleeves shown removed from the post.

FIG.*7a* is a cross section on line *7a—7a* of FIG. 7.

FIG. 8 is a side view of one of the sleeves shown fragmentarily and partly in cross section.

FIG. 9 shows one of the sleeves in use exercising the fingers.

FIG. 10 shows the other sleeve in use exercising the hands.

Figure 1:
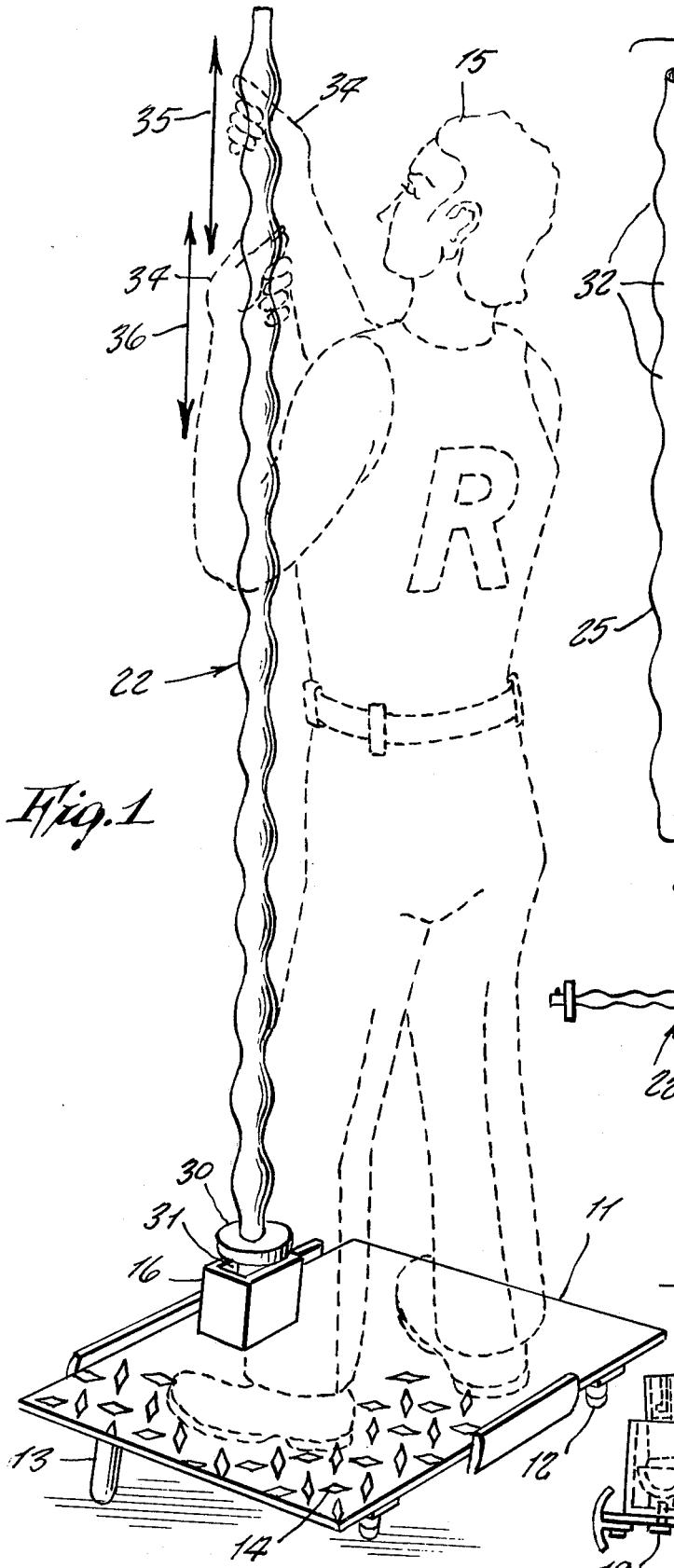
FIG. 1 is a perspective view of the invention showing the bar secured to the platform.
Figure 2:
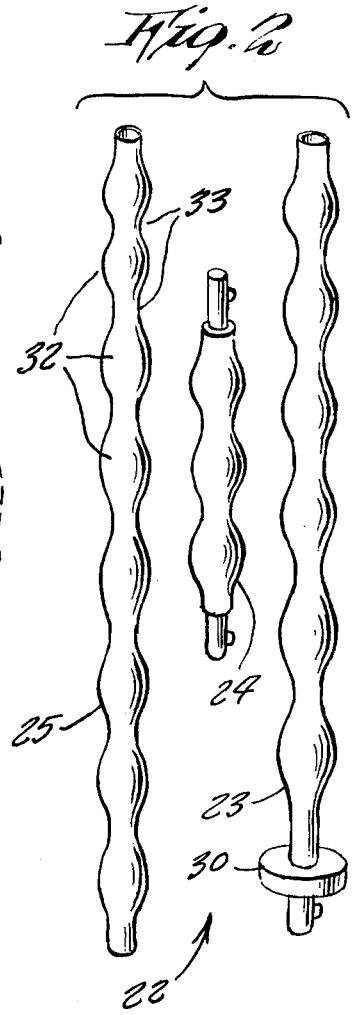
FIG. 2 is a view of the bar disassembled.
Figure 3:
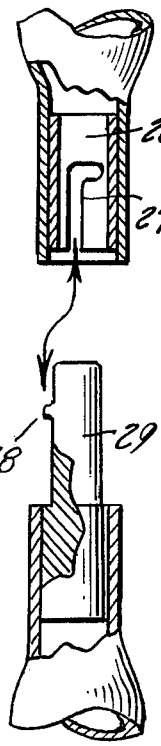
FIG. 3 is a cross-section of one of the joint components.

Referring now to the drawings in greater detail, the reference numeral 10 represents a polytetrafluoroethylene Exercising Post Kit with Repetitive Varying Diameter according to the present invention wherein there is a platform 11 supported inclined upon short legs 12 and long legs 13, the platform being of plate herring raised pattern 14 on its upper side so as to prevent a person 15 standing there-upon from readily slipping. A rectangular metal box 16 containing a socket 17 of a ball and socket joint 18 are both secured to the platform by a bolt 19. A ball 20 of the joint is integral with a tubular section 21 connectable to a pole 22 which may be made either in one piece, or as shown in Figure 2, is made of interconnecting sections 23, 24 and 25. All the sections are made of a tubular, light weight metal such as aluminum and their ends are interconnectable by means of a metal sleeve 26 fitted on an end of one section having a bayonet slot 27 that is engagable with a sideward protrusion 28 of pin 29 protruding outwardly of an end of another of the sections. A lowermost section 23 of the post engagable with ball joint section 21 additionally includes a circular flange 30 affixed thereto for covering a top opening 31 of the box.

Figure 4:
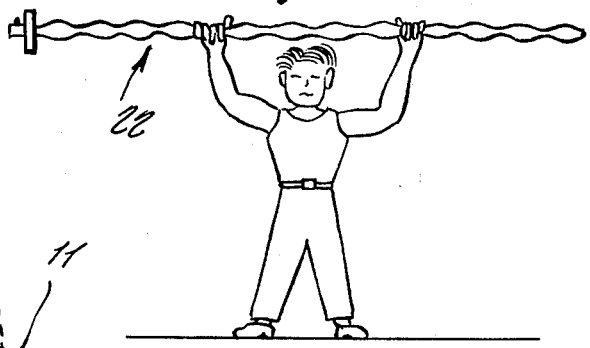
FIG. 4 shows the bar in use alone.
Figure 5:
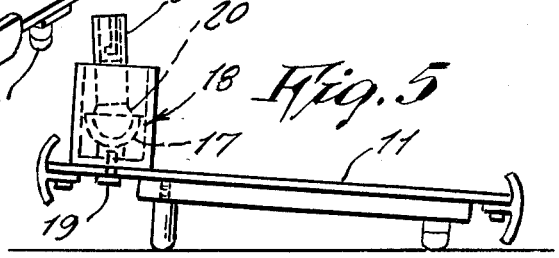
FIG. 5 is a side view of the platform.

In the present invention the sections of the post are made with repetitive varying diameters by having equally spaced apart bulbous enlargements 32 formed between constricting portions 33. The entire outer surface of the post sections is polytetrafluoroethylene coated so that in use a person 15 firmly grasping the post with hands 34 can slide his hands along the post as shown by arrows 35 and 36, the hands thus being forced to open and close their grasp of the post as they move between enlargements 32 and portions 33. This forces movement of the joints of the fingers and hands for a very thorough exercising thereof and strengthening the muscles. The enlargements may be either of a same or progressively larger diameter toward one end of the post. The post can be readily disassembled as shown in Figure 2 for storing in a small space, or for convenient transporting. The post is removable from the section 21 so that alternatively it can be used separately, as shown in FIG. 4, for doing a variety of other exercises to aid in toning and strengthening other parts of the body.

The present invention also includes a long pipe 37 for exercising and strengthening the wrists and a short pipe 38 for exercising and strengthening the figgers. Each of the pipes consists of a foam rubber core 39 around a central tubualar opening 40, the core being filled inside a metal tube 41 which upon its outer side is coated with a polytetrafluoroethylene 42. Each pipe is fluted on its outer side; the pipe 37 having flutes 43 extending the entire length of the pipe, while the pipe 38 has flutes 44 only around its center portion.

In use as shown in FIG. 9, the pipe 39 is grasped around its outer ends between the hands and the ends of the fingers 45 grasp the fluted central portion. The pipe is then twisted by both hands in opposite direction as shown by arrows so as to exercise the fingers.

The pipe 37, in use is grasped by both hands, as shown in FIG. 10, and is then twisted in opposite directions as shown by arrows 47 so as to exercise the wrists 48. When not in use, the pipes 37 and 38 are stored around an upper end of the pipe as shown in FIG. 6.

Thus an improved exercising device is provided.

While certain novel features of this invention have been whown and described and are pointed out in the annexed claims, it will be understood that various omissions, substitutions and changes in the forms and details of the device illustrated and in its operation can be made by those skilled in the art without departing from the spirit of the invention.

I claim:

1. A polytetrafluoroethylene coated exercising post kit with repetitive varying diameters, comprising in combination, an inclined platform, an upstanding post supported pivotally upon a ball and socket joint mounted upon said platform and a pair of removable pipes stored upon an upper end of said post; said post and pipes providing means for exercising various parts of a person's body; wherein said post is made of tubular metal sections interconnected together, an outer surface of said post being coated with polytetrafluoroethylene and said post being formed with spaced apart bulbous enlargements throughout its length.

2. The combination as set forth in claim 2, wherein a first said pipe consists of metal tubes fluted on its outer side throughout its length, an outer side of said tube being polytetrafluoroethylene coated, and a foam rubber tubular core being inside said tube.

3. The combination as set forth in claim 2 wherein a second said pipe is shorter in length than first said pipe and consists of a metal tube fitted with a foam rubber tubular core on its inner side, an outer side of said metal tube being coated with polytetrafluoroethylene and a longitudinally intermediate portion of said metal tube being fluted.

* * * * *